US009314669B2

(12) United States Patent
Oh

(10) Patent No.: US 9,314,669 B2
(45) Date of Patent: Apr. 19, 2016

(54) TOTAL-BODY EXERCISER

(75) Inventor: Seung Hoon Oh, Bucheon-si (KR)

(73) Assignee: OVERTECH CO., LTD., Gyeonggi-Do (KR)

( * ) Notice: Subject to any disclaimer, the term of this patent is extended or adjusted under 35 U.S.C. 154(b) by 143 days.

(21) Appl. No.: 14/122,742

(22) PCT Filed: May 29, 2012

(86) PCT No.: PCT/KR2012/004198

§ 371 (c)(1),
(2), (4) Date: Nov. 27, 2013

(87) PCT Pub. No.: WO2012/165828

PCT Pub. Date: Dec. 6, 2012

(65) Prior Publication Data

US 2014/0100093 A1 Apr. 10, 2014

(30) Foreign Application Priority Data

May 30, 2011 (KR) ..... 10-2011-0051408

(51) Int. Cl.
*A63B 26/00* (2006.01)
*A61H 1/00* (2006.01)
*A61H 1/02* (2006.01)

(52) U.S. Cl.
CPC ..... *A63B 26/00* (2013.01); *A61H 1/001* (2013.01); *A61H 1/0237* (2013.01); (Continued)

(58) Field of Classification Search
CPC ..... A63B 21/00047; A63B 2210/50; A63B 21/1457; A63B 23/0216; A63B 2208/0252; A63B 23/0488; A63B 2208/0242; A63B 23/035; A63B 22/12; A63B 22/06; A63B 23/00; A63B 26/00; A61H 1/00; A61H 1/02; A61H 2015/0014; A61H 2201/0149; A61H 2201/1238; A61H 2201/1671; A61H 2201/1676; A61H 2205/08; A61H 15/00
USPC ..... 482/142–146; 601/32, 33, 36
See application file for complete search history.

(56) References Cited

U.S. PATENT DOCUMENTS 1,482,173 A * 1/1924 Willard ..... 606/240
1,686,979 A * 10/1928 McManis ..... 601/24

(Continued)

FOREIGN PATENT DOCUMENTS

JP 11-076347 3/1999
KR 20-0163141 9/1999

(Continued)

*Primary Examiner* — Stephen Crow
*Assistant Examiner* — Andrew S Lo
(74) *Attorney, Agent, or Firm* — IPLA P.A.; James E. Bame

(57) ABSTRACT

A total-body exerciser comprises: an upper-body exercising unit; a buttocks exercising unit; and an ankle exercising unit. The upper-body exercising unit comprises: an upper-body support for supporting the upper body; an upper-body supporting guide rail formed on the bottom surface of the upper-body support and enabling the upper-body support to move horizontally; and a rotating bracket mounted on a lower surface of the upper-body supporting guide rail. The buttocks exercising unit comprises: a buttocks support for supporting the buttocks; and a buttocks-supporting height-adjusting cylinder connected to a lower portion of the buttocks support, and capable of adjusting the height of the buttocks support. The ankle exercising unit comprises: an ankle support for supporting an ankle; an ankle-supporting guide rail formed on a bottom surface of the ankle support and enabling horizontal movement of the ankle support; and a rotating bracket mounted on a lower surface of the ankle-support guide rail.

7 Claims, 6 Drawing Sheets

(52) U.S. Cl.
CPC ..... *A61H 1/0292* (2013.01); *A61H 2201/1215* (2013.01); *A61H 2201/1246* (2013.01); *A61H 2201/1418* (2013.01); *A61H 2201/1436* (2013.01); *A61H 2201/164* (2013.01); *A61H 2201/1623* (2013.01); *A61H 2201/1628* (2013.01); *A61H 2201/1664* (2013.01); *A61H 2201/1676* (2013.01); *A61H 2203/0456* (2013.01)

(56) References Cited

U.S. PATENT DOCUMENTS

| | | | | | |
|---|---|---|---|---|---|
| 1,938,006 | A | * | 12/1933 | Blanchard | 606/245 |
| 2,548,408 | A | * | 4/1951 | Tammen | 601/32 |
| 2,666,429 | A | * | 1/1954 | Alexander et al. | 601/92 |
| 2,681,650 | A | * | 6/1954 | Goss | 601/98 |
| 2,869,539 | A | * | 1/1959 | Mosse | 601/98 |
| 2,886,028 | A | * | 5/1959 | Vogtmann et al. | 601/24 |
| 2,893,380 | A | * | 7/1959 | Walker et al. | 601/24 |
| 3,060,926 | A | * | 10/1962 | May | 601/35 |
| 3,315,667 | A | * | 4/1967 | Yoder | 606/245 |
| 3,450,132 | A | * | 6/1969 | Ragon et al. | 601/26 |
| 3,735,754 | A | * | 5/1973 | Reed | 601/26 |
| 5,066,005 | A | * | 11/1991 | Luecke | 482/96 |
| 5,328,424 | A | * | 7/1994 | Greco | 482/73 |
| 5,376,060 | A | * | 12/1994 | Murray | 482/56 |
| 5,669,865 | A | | 9/1997 | Gordon | |
| 5,782,869 | A | * | 7/1998 | Berdut | 606/242 |
| 5,860,899 | A | * | 1/1999 | Rassman | 482/142 |
| 5,901,581 | A | * | 5/1999 | Chen et al. | 601/34 |
| 6,821,288 | B2 | * | 11/2004 | Schaeffer | 606/240 |
| 2006/0097557 | A1 | * | 5/2006 | Tholkes et al. | 297/330 |
| 2007/0043308 | A1 | * | 2/2007 | Lee | 601/34 |
| 2008/0132383 | A1 | * | 6/2008 | Einav et al. | 482/8 |
| 2008/0134434 | A1 | * | 6/2008 | Celauro | 5/610 |
| 2009/0098984 | A1 | * | 4/2009 | Smyrk et al. | 482/72 |
| 2011/0152032 | A1 | * | 6/2011 | Barnett | 482/5 |

FOREIGN PATENT DOCUMENTS

| | | |
|---|---|---|
| KR | 2000-0017748 | 10/2000 |
| KR | 1020040025494 | 3/2004 |
| KR | 1020100008282 | 1/2010 |
| WO | WO2010-085111 | 7/2010 |

* cited by examiner

TOTAL-BODY EXERCISER

BACKGROUND

The present invention relates to a total-body exerciser, and more particularly, to a total-body exerciser capable of rotating and vertically moving each part of the body in order to strengthen the waist, the back, the abdomen, and the knee joints.

In general, with advancement of the modern society, people have high exposure to modern diseases due to lack of exercise or excessive consumption of foods.

Particularly, due to a strained posture, overwork or aging, the human body is exposed to degenerative lumbar disk diseases occurring in the waist, the back, the abdomen, or the knees, scoliosis that the spine is curved, fascial pains in the hip joint and waist parts, degeneration in growth due to stress, oversized stomach, and others. Therefore, in order to solve the above problems, people do exercises for a long time, and have help from various exercisers or from professional trainers.

According to such a trend, lots of exercisers for strengthening each part of the body or strengthening the whole body have been released and developed.

For instance, exercisers of various kinds, such as cervical spinal exercisers, abdominal exercisers, electronic leg joint exercisers, lower body exercisers, aerobic exercisers, spine correction exercisers, boxing game exercisers, pelvic muscle exercisers, body type exercisers for the whole body, back acupressure exercisers, grasping power exercisers, shoulder twisting exercisers, multi-purpose exercisers, total-body exercisers, and others, have been used and developed.

In spite of the great deal of exercisers, it is clear that more convenient, effective and efficient exercisers would be continuously developed and used.

SUMMARY OF THE INVENTION

Accordingly, the present invention has been made in an effort to solve the above-mentioned problems occurring in the prior arts, and it is an object of the present invention to provide a total-body exerciser capable of making the human body's waist, abdomen and knee joints flexible and strengthening muscular strength.

It is another object of the present invention to provide a total-body exerciser capable of strengthening muscular strength, removing abdominal fat, strengthening flexibility and functions of internal organs, and enhancing mental relaxation effect so as to solve the problems of degenerative lumbar disk diseases of the middle-aged and the old-aged, scoliosis due to bad life habits, fascial pains in the hip joint and waist parts, and degeneration in growth due to stress of adolescent generation.

It is a further object of the present invention to provide a total-body exerciser which allows a user to do exercise of the whole body using a head support, an upper body and shoulders support, a middle butt and waist support, a knee support and an ankle support in a state where the user lays down on the exerciser comfortably according to movements of the exerciser.

To achieve the above objects, the present invention provides a total-body exerciser including: an upper body exercising part including an upper body support for supporting a user's upper body, upper body support guide rails formed below the upper body support for allowing a horizontal movement of the upper body support, and a rotational bracket mounted on the bottom face of the upper body support guide rails such that the upper body support is capable of rotating on a base frame abutting on the ground; a hip exercising part including a hip support for supporting the user's hips, and a hip support height-adjustable cylinder connected below the hip support for adjusting height of the hip support; and an ankle exercising part including an ankle support for supporting the user's ankles, ankle support guide rails formed below the ankle support for allowing a horizontal movement of the ankle support, and a rotational bracket mounted on the bottom face of the ankle support guide rails such that ankle support is capable of rotating on the base frame abutting on the ground.

Here, the hip exercising part includes: a reciprocating rotation crank rod connected with the lower end of the hip support height-adjustable cylinder for rotating the hip support; a cam whose one end is connected with the reciprocating rotation crank rod by the medium of a link fixing shaft and the other end is connected with a power transferring main shaft; and the link fixing shaft whose center is connected with a power source by a power transmission unit and both sides are connected with the cam.

Moreover, the upper body exercising part is in interlock with the hip exercising part and is connected with the hip exercising part by a reciprocating connection link shaft so as to be moved at vertical angles.

Furthermore, the total-body exerciser further includes a knee exercising part including a knee support for supporting the knees, and a knee support height-adjustable cylinder connected below the knee support for adjusting height of the knee support.

Additionally, the hip exercising part includes: a reciprocating rotation crank rod connected with the lower end of the hip support height-adjustable cylinder such that the hip support carries out a circular orbit movement; and a cam whose one end is connected with the reciprocating rotation crank rod by the medium of a link fixing shaft and the other end is connected with a power transferring main shaft.

In addition, the knee exercising part includes: a lower body reciprocating link rod connected with the lower end of the knee support height-adjustable cylinder for rotating the knee support; and a lower body rotating cam whose one end is connected with the lower body reciprocating link rod by the medium of the link fixing shaft and the other end is connected with the cam by the medium of a cam fixing and supporting plate.

Moreover, the ankle exercising part is in interlock with the knee exercising part and is connected with the lower body reciprocating link rod by a reciprocating conveyance connection shaft such that the ankle exercising part is moved at vertical angles.

Furthermore, the upper body exercising part is in interlock with the hip exercising part and is connected with the hip exercising part by a reciprocating connection link shaft such that the upper body exercising part is moved at vertical angles.

According to the exemplary embodiment of the present invention, the total-body exerciser can provide flexibility to the human body's waist and abdomen and strengthen muscular strength of the waist and abdomen, help to treat degenerative lumbar disc diseases of the middle-aged and the old-aged and knee diseases and hip joint diseases due to lack of exercises, and help to treat spinal diseases such as scoliosis that the spine is curved due to bad life habits, fascial pains in the hip joint and waist parts, and degeneration in growth due to stress of adolescent generation, degenerative arthritis of the old-aged, and pains on strained spine or knee joints.

DETAILED DESCRIPTION OF THE INVENTION

Referring to the attached drawings, the structure, operation and effects of a total-body exerciser according to a preferred embodiment of the present invention will be described.

Figure 1:
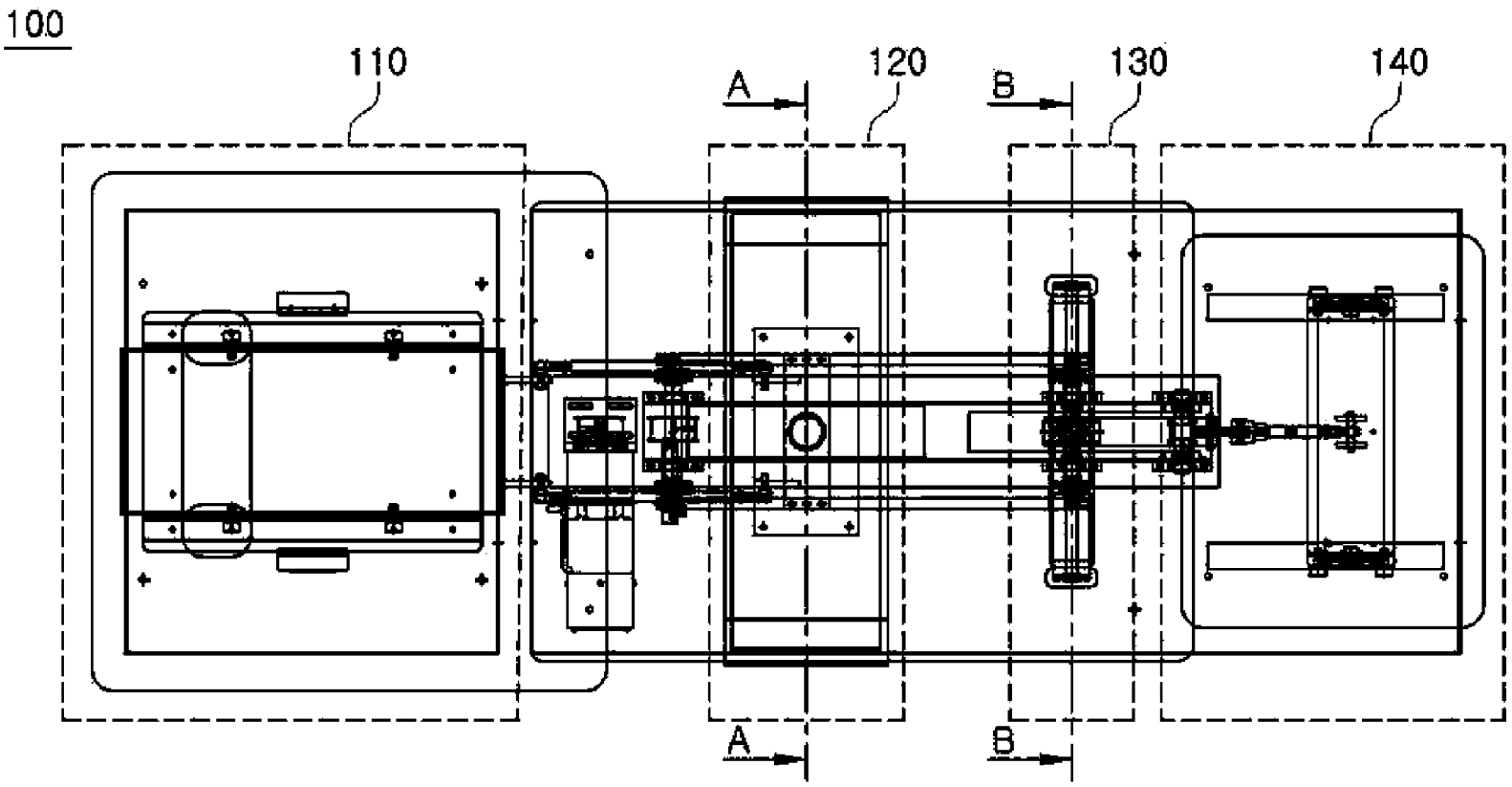
FIG. 1 is a front view of a total-body exerciser according to a preferred embodiment of the present invention.
Figure 2:
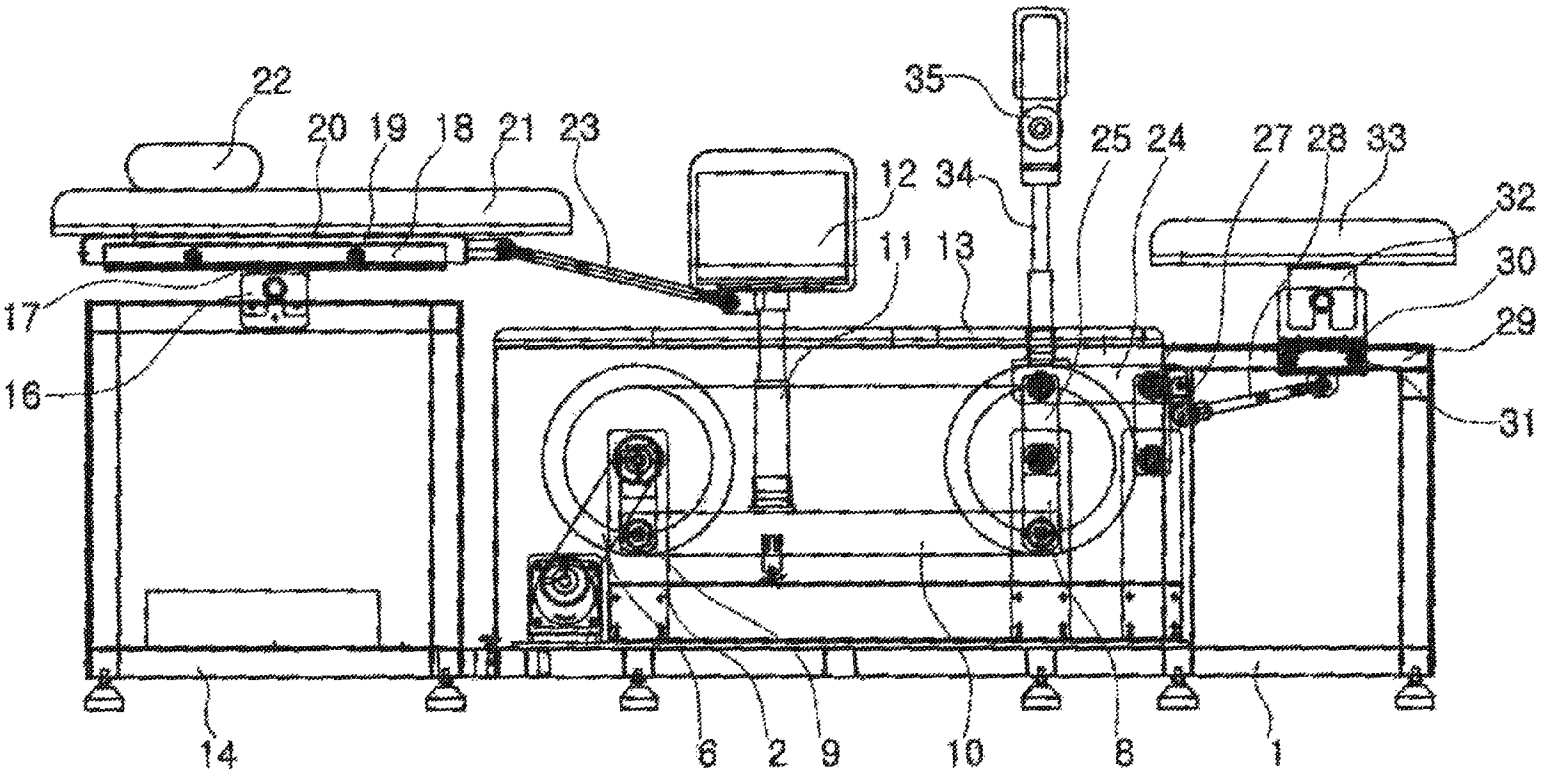
FIG. 2 is a plan view of the total-body exerciser.
Figure 3:
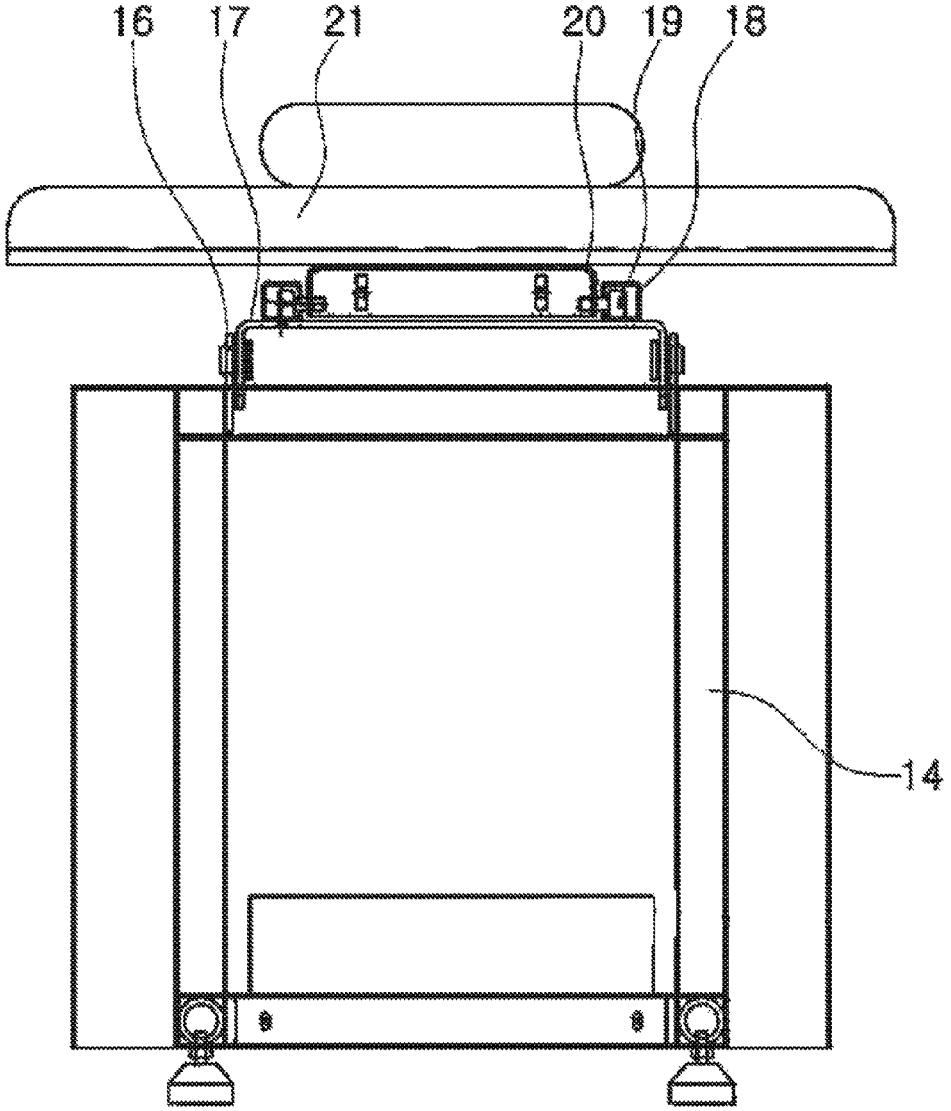
FIG. 3 is a left side view of the total-body exerciser.
Figure 4:
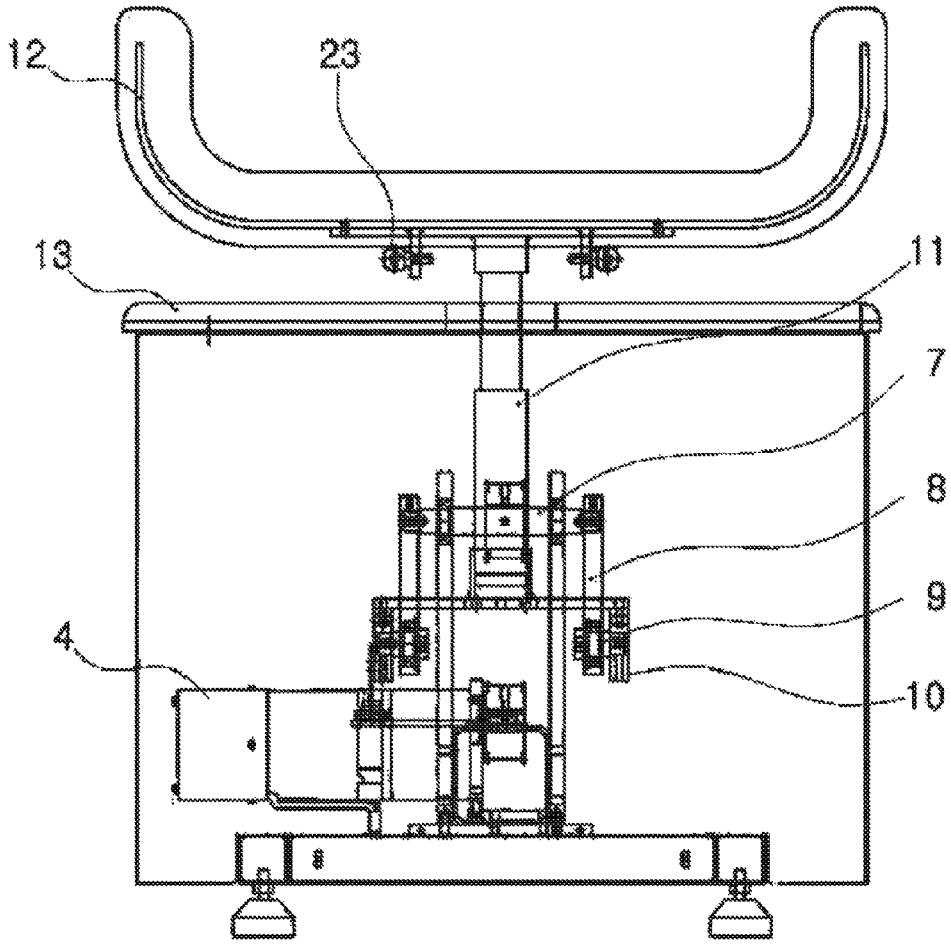
FIG. 4 is a sectional view taken along the line of A-A of FIG. 1.
Figure 5:
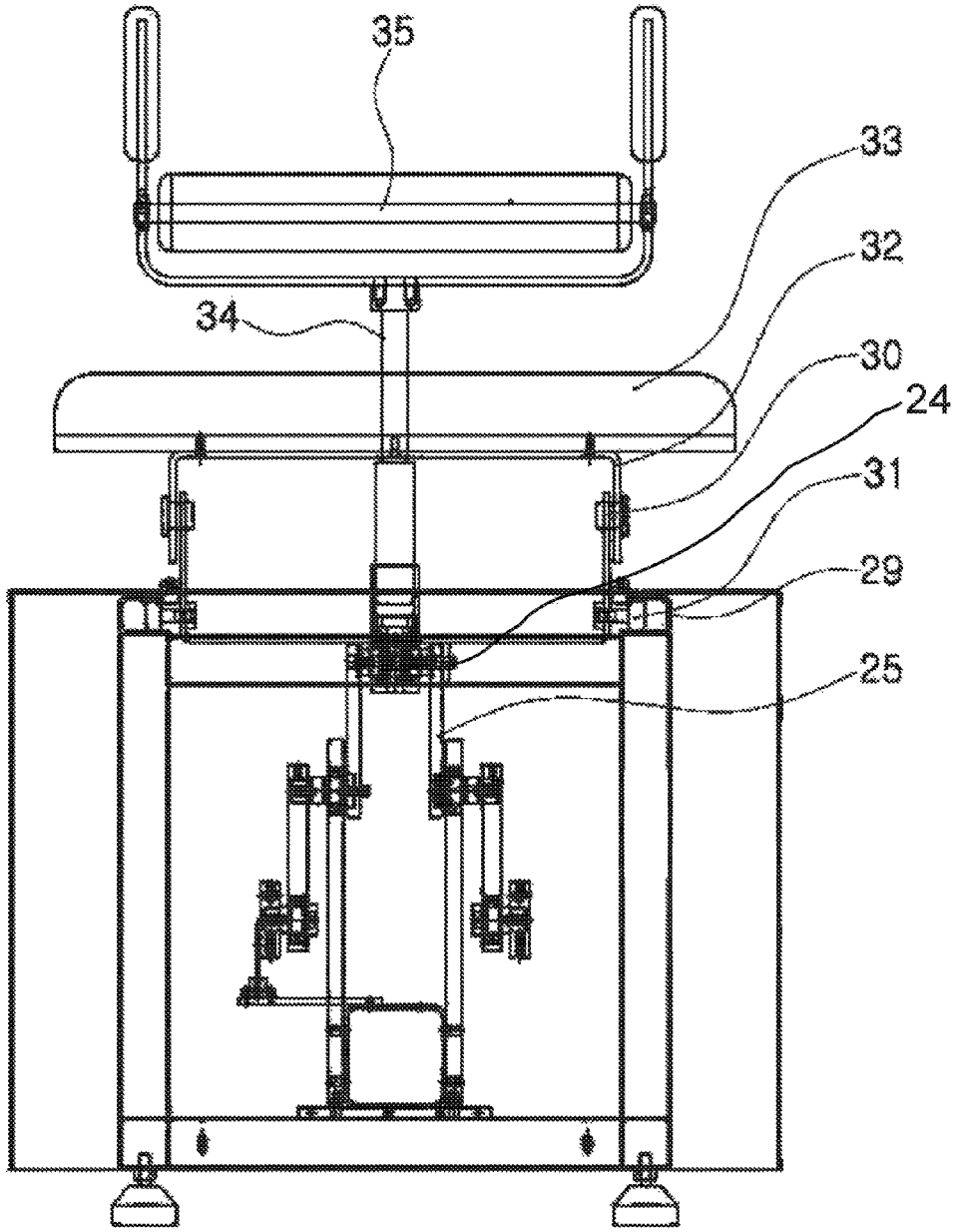
FIG. 5 is a sectional view taken along the line of B-B of FIG. 1.
Figure 6:
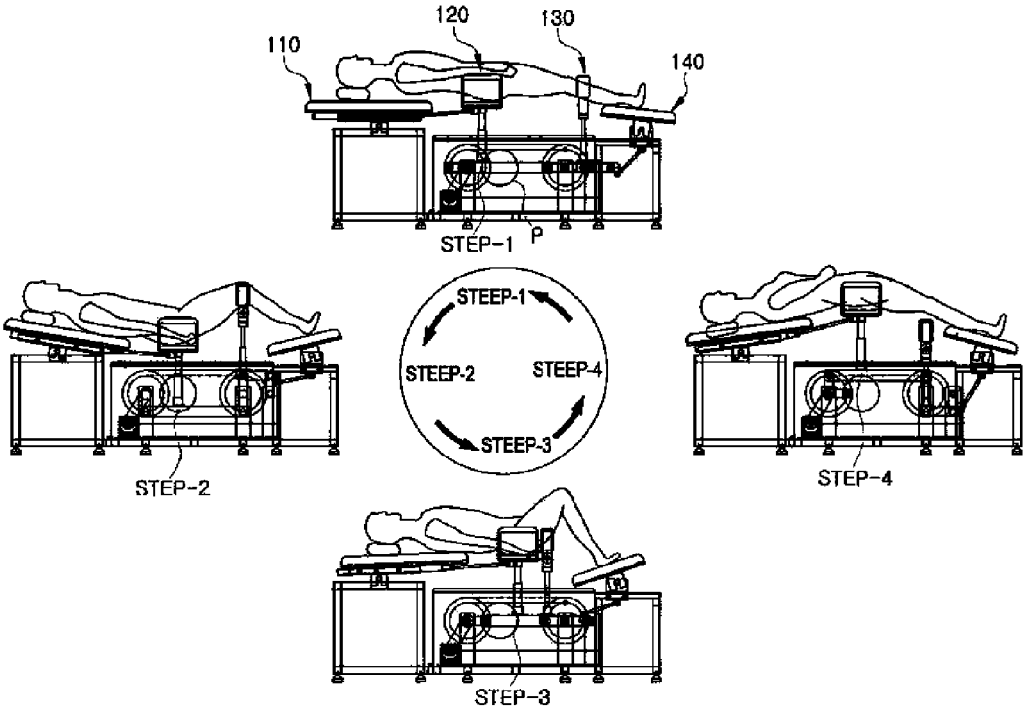
FIG. 6 is a view for explaining an operation of the total-body exerciser according to the preferred embodiment of the present invention.

FIG. 1 is a front view of a total-body exerciser according to a preferred embodiment of the present invention, FIG. 2 is a plan view of the total-body exerciser, FIG. 3 is a left side view of the total-body exerciser, FIG. 4 is a sectional view taken along the line of A-A of FIG. 1, FIG. 5 is a sectional view taken along the line of B-B of FIG. 1, and FIG. 6 is a view for explaining an operation of the total-body exerciser according to the preferred embodiment of the present invention.

As shown in the drawings, the total-body exerciser 100 according to the preferred embodiment of the present invention includes an upper body exercising part 110, a hip exercising part 120, a knee exercising part 130, and an ankle exercising part 140.

Here, even though the knee exercising part 130 is selectively added or omitted, there is no difficulty in realizing the present invention, but, hereinafter, the preferred embodiment of the exerciser including the knee exercising part 130 will be described.

The upper body exercising part 110 is a part where a user's head and shoulders directly touch, and carries out a tilting motion to be tilted vertically and a horizontal motion to be horizontally moved in back and forth directions by guide rails.

The hip exercising part 120 is a part on which the user's hips are located, and supports the user's waist together with the upper body exercising part 110. The hip exercising part 120 is adjustable in its height by a cylinder and carries out a rotational motion and a rectilinear motion by a rotor and a cam structure.

The knee exercising part 130 is a part on which the user's knees are located, and is adjustable in its height by a cylinder and carries out a rotational motion and a rectilinear motion by a cam structure.

The ankle exercising part 140 is a part on which the user's ankle parts are put, and like the upper body exercising part 110, carries out a tilting motion to be tilted vertically and a horizontal motion to be horizontally moved in back and forth directions by guide rails.

The upper body exercising part 110, the hip exercising part 120, the knee exercising part 130 and the ankle exercising part 140 may be separately operated or may be operated in interlock with one another. Hereinafter, the exemplary embodiment of the total-body exerciser including the upper body exercising part 110, the hip exercising part 120, the knee exercising part 130 and the ankle exercising part 140 which are operated in interlock with one another will be described.

The upper body exercising part 110 includes an upper body support 21, a roller fixing plate 20, an upper body support guide rails 18, conveyance guide rollers 19, a rotational table 17, and a rotational bracket 16.

The upper body support 21 is a part on which the user's head and shoulders are put, and a pillow 22 may be formed on the head part. The roller fixing plate 20 is formed below the upper body support 21, the upper body support guide rails 18 are formed at both sides of the roller fixing plate 20, and the conveyance guide rollers 19 are rotatably put on the upper body guide rails 18 and are fixed to the roller fixing plate 20.

The rotational table 17 is located below the roller fixing plate 20 and the upper body support guide rails 18, and the rotational bracket 16 is rotatably connected between the rotational table 17 and an upper base frame 14.

The upper body support 21 freely carries out a back and forth horizontal motion by the upper body support guide rails and the conveyance guide rollers 19, and can carry out a tilting motion because tilting laterally by the rotational bracket 16 according to the center of gravity.

Moreover, the upper body support 21 is connected with the lower end portion of the hip support 12 of the hip exercising part 120 by a reciprocating connection link shaft 23, such that the upper body exercising part 21 moves in interlock with the operation of the hip exercising part 120.

The hip exercising part 120 includes the hip support 12, hip support height-adjustable cylinder 11, a reciprocating rotation crank rod 10, a cam 8, a link fixing shaft 9, and a power transferring main shaft 7.

The hip support 12 is a part on which the user's hips are put, and is adjustable in its height by the hip support height-adjustable cylinder 11 connected below the hip support 12. A main body frame 1 is formed under the hip support 12, and an auxiliary die mat 13 is formed on the upper surface of the main body frame 1.

The reciprocating rotation crank rod 10 horizontally put at both sides of the lowermost end of the hip support height-adjustable cylinder 11, and is connected with one end of the cam 8 by the medium of the link fixing shaft 9. The other end of the cam 8 is connected with the power transferring main shaft 7.

The power transferring main shaft 7 is connected with a motor and reducer 4, which is a power transmission medium, by the medium of a power transmission unit 6 including a belt, gears and a chain so as to receive a driving force. The motor and reducer 4 is fixed by a motor and reducer fixing bracket 4.

The hip exercising part 120 having the above structure carries out a straight reciprocating motion while rotating a circular orbit by the reciprocating rotation crank rod 10 and the cam 8.

The knee exercising part 130 includes a knee support 35, a knee support height-adjustable cylinder 34, a lower body reciprocating link rod 24, and a lower body rotating cam 25.

The knee support 35 is a part on which the lower part of the knee is located, and is adjustable in its height by the knee support height-adjustable cylinder 34.

The lower body rotating cam 25 is horizontally connected to both sides of the lower end of the knee support height-adjustable cylinder 34 and is connected at a right angle to the lower body reciprocating link rod 24. The lower body rotating cam 25 is operably connected with the cam 8 through the link fixing shaft 9 by the medium of a cam fixing and supporting plate 2.

According to the above-mentioned structure, the knee exercising part 130 carries out the straight reciprocating motion while rotating the circular orbit by the reciprocating link rod 24, the lower body rotating cam 25, the link fixing shaft 9 and the cam 8, and such a straight reciprocating motion is carried out in interlock with the hip exercising part 120.

The ankle exercising part 140 includes an ankle support 33, a rotational bracket 32, a slide/rotary shaft fixing plate 30, conveying rollers 31, and ankle support guide rails 29.

The ankle support 33 is a part on which the ankle parts of the legs are put, and the rotational bracket 32 is rotatable freely and is connected between the ankle support 33 and the sliding/rotary shaft fixing plate 30. The ankle support guide rails 29 are formed below the rotational bracket 32, and the conveying rollers 31 are mounted inside the ankle support guide rails 29 in such a way as to be moved horizontally.

Furthermore, a reciprocating conveyance connection shaft 28 is connected between the lower end of the ankle exercising part 140 and the lower body reciprocating link rod 24 of the knee exercising part 130 by the medium of an auxiliary link 27.

The reciprocating conveyance connection shaft 28 makes the knee exercising part 140 interlock with the knee exercising part 130, such that the ankle exercising part 140 is also interlocked with the hip exercising part 120.

Based on the hip exercising part 120, the upper body exercising part 110 is interlocked at the left side and the knee exercising part 130 and the ankle exercising part 140 are interlocked at the right side, such that the total-body exerciser can exercise the user's whole body through the overall interlock motion.

FIG. 6 is a view for explaining an operation of the total-body exerciser according to the preferred embodiment of the present invention.

In FIGS. 1 to 5, the structure and the connection relationship of the total-body exerciser 100 according to the preferred embodiment of the present invention are described. Based on the above, referring to FIG. 6, the operation of the total-body exerciser 100 will be described according to position changes by steps of the upper body exercising part 110, the hip exercising part 120, the knee exercising part 130, and the ankle exercising part 140 with the circular orbit of the hip exercising part 120 as the center.

In FIG. 6, in the state where the user lies on, in four directions from a circular movement orbit P of the hip exercising part 120, positions of the upper body exercising part 110, the hip exercising part 120, the knee exercising part 130 and the ankle exercising part 140 by steps will be described.

First, the case that the center of the hip exercising part 120 is located at the position STEP-1 with the circular movement orbit P as the center will be described.

When the center of the hip exercising part 120 is located at the position STEP-1, the positions of the upper body exercising part 110, the hip exercising part 120, the knee exercising part 130 and the ankle exercising part 140 are set as shown in the drawing, such that the user can lie down on the exerciser comfortably according to the user's body structure.

When the exerciser is changed from the position STEP-1 to the position STEP-2, the hip exercising part 120 moves from the left to the right while lowering to the lowermost height, and the upper body exercising part 11 moves as long as the same distance along the upper body support guide rails 18 by the reciprocating connection link shaft 23 in interlock with the lateral movement of the hip exercising part 120, such that the center of gravity is moved to the left and the upper body support 21 is tilted to the right.

Likewise, on the contrary to the hip exercising part 120, the knee exercising part 130 moves to the uppermost side in interlock with the hip exercising part 120, such that the user's knees are bent at an angle of nearly 90 degrees.

The ankle exercising part 140 is interlocked with the knee exercising part 130 by the reciprocating conveyance connection shaft 28 and moves from the right to the left by the ankle support guide rails 29, such that the center of gravity is tilted to the left and the ankle support 33 is tilted to the left.

When the hip exercising part 120 is changed to the position STEP-3, the hip exercising part 120 moves more from the left to the right, and hence, the upper body exercising part 110 is also moved horizontally in interlock with the hip exercising part 120 and the left side of the upper body exercising part 110 is at a slight tilt. Moreover, the knee exercising part 130 is moved to the maximum height, such that the knee parts are bent more than those in the position STEP-2 and the ankle support 33 is also tilted to the left.

Continuously, when the hip exercising part 120 is located at the uppermost point, namely, when the hip exercising part 120 is located at the position STEP-4, the upper body exercising part 110 is tilted to the left at the utmost, and on the contrary, the ankle exercising part 140 is tilted to the right at the utmost, and the knee exercising part 130 supports the knees at the medium height between the hip exercising part 120 and the ankle exercising part 140.

Now, the user's states in the positions STEP-1 to STEP-4 will be described. In STEP-1, the user lies down on the exerciser comfortably, and in STEP-2, the user's head faces upward, the hip part is located at the lowermost point, and the knee parts are bent at nearly 90 degrees. In STEP-3, the user's head and hips are put in a straight line, the knee parts are located at the maximum height, and the feet parts support the maximum height of the knees. In STEP-4, the user's head and feet lower but the hip parts are raised to the maximum height.

As described above, while the present invention has been particularly shown and described with reference to the exemplary embodiments thereof, it will be understood by those of ordinary skill in the art that the exemplary embodiments of the present invention may be made therein without changing the essential characteristics and technical scope of the present invention. Therefore, it would be understood that the exemplary embodiments of the present invention are all exemplified and are not limitative, that the technical and protective scope of the present invention shall be defined by the technical idea as defined by the following claims, and that the exemplary embodiments of the present invention are to cover all modifications, equivalents, and alternatives falling within the spirit and scope of the invention defined by the claims.

The invention claimed is:

1. A total-body exerciser comprising:

an upper body exercising part including an upper body support for supporting a user's upper body, upper body support guide rails formed below the upper body support for allowing a horizontal movement of the upper body support, and a rotational bracket mounted on a bottom face of the upper body support guide rails such that the upper body support is capable of rotating on a base frame abutting on the ground;

a hip exercising part including a hip support for supporting the user's hips, and a hip support height-adjustable cylinder connected below the hip support for adjusting a height of the hip support; and an ankle exercising part including an ankle support for supporting the user's ankles, ankle support guide rails formed below the ankle support for allowing a horizontal movement of the ankle support, and a rotational bracket mounted on the bottom face of the ankle support guide rails such that ankle support is capable of rotating on the base frame abutting on the ground, wherein the upper body exercising part is in interlock with the hip exercising part and is connected with the hip exercising part by a reciprocating connection link shaft so as to be moved at vertical angles.

2. The total-body exerciser according to claim 1, wherein the hip exercising part comprises:

a reciprocating rotation crank rod connected with a lower end of the hip support height-adjustable cylinder for rotating the hip support; and a cam whose one end is connected with the reciprocating rotation crank rod by a medium of a link fixing shaft and another end is connected with a power transferring main shaft.

3. The total-body exerciser according to claim 1, further comprising:

a knee exercising part including a knee support for supporting the knees, and a knee support height-adjustable cylinder connected below the knee support for adjusting a height of the knee support.

4. The total-body exerciser according to claim 3, wherein the hip exercising part comprises:

a reciprocating rotation crank rod connected with a lower end of the hip support height-adjustable cylinder such that the hip support carries out a circular orbit movement; and a cam whose one end is connected with the reciprocating rotation crank rod by a medium of a link fixing shaft and another end is connected with a power transferring main shaft.

5. The total-body exerciser according to claim 4, wherein the knee exercising part comprises:

a lower body reciprocating link rod connected with a lower end of the knee support height-adjustable cylinder for rotating the knee support; and a lower body rotating cam whose one end is connected with the lower body reciprocating link rod by a medium of the link fixing shaft and another end is connected with the cam by a medium of a cam fixing and supporting plate.

6. The total-body exerciser according to claim 5, wherein the ankle exercising part is in interlock with the knee exercising part and is connected with the lower body reciprocating link rod by a reciprocating conveyance connection shaft such that the ankle exercising part is moved at vertical angles.

7. The total-body exerciser according to claim 6, wherein the upper body exercising part is in interlock with the hip exercising part and is connected with the hip exercising part by a reciprocating connection link shaft such that the upper body exercising part is moved at vertical angles.

* * * * *